United States Patent [19]

Wahl

[11] 4,006,739

[45] Feb. 8, 1977

[54] BACK MASSAGER

[75] Inventor: John F. Wahl, Sterling, Ill.

[73] Assignee: Wahl Clipper Corporation, Sterling, Ill.

[22] Filed: Nov. 7, 1975

[21] Appl. No.: 629,780

[52] U.S. Cl. ..... 128/33

[51] Int. Cl.[2] ..... A61H 1/00

[58] Field of Search ..... 128/33–36, 128/41, 24.2

[56] References Cited

UNITED STATES PATENTS

| | | | |
|---|---|---|---|
| 2,902,993 | 9/1959 | Wagner | 128/33 |
| 2,937,641 | 5/1960 | Oetinger | 128/33 |
| 2,939,454 | 6/1960 | Lychtenstein | 128/33 |

*Primary Examiner*—Lawrence W. Trapp
*Attorney, Agent, or Firm*—Carl C. Batz

[57] ABSTRACT

A portable cushion containing a vibratory mechanism. The cushion includes a back padding and a front padding and between these paddings is a rigid or semi-rigid frame member which carries the vibratory mechanism. This mechanism is contained in a casing which is located in the lower portion of the frame member. The position of the casing is such that when a cushion is placed next to the back of a chair with its lower end resting on the seat of the chair, the casing will be approximately even with the lumbar region of an adult sitting in the chair.

6 Claims, 7 Drawing Figures

BACK MASSAGER

This invention relates to a cushion which delivers a massaging or vibrating action to the back of the person using it, and relates particularly to such a cushion which is portable and can be placed in front of a chair back, the cushion being operative to deliver a massaging or vibrating sensation to the lumber region of the person's back.

BACKGROUND

It has been common to provide portable cushions which may be placed in a chair and against the back of the chair to give greater comfort to the person sitting in the chair. Usually such cushions form a pillow at the upper portion against which the person may rest his head. Also it has been known that vibrating devices may be provided and these devices have been mounted on the framework of the beds, chairs and the like for the purpose of contributing a vibrating motion or a massaging effect which is relaxing to the person lying on the bed or sitting on the chair. Attempts have also been made to construct portable cushions having the vibrating or massaging feature and in such attempts the upper pillow portion of the cushion has been given enlarged thickness with the vibrating mechanism located in this pillow portion of the cushion. Such structures have not proved to be fully satisfactory, and I have set about to provide improved structures which will provide greater comfort to the person using the cushion and yield a more satisfying sensation from the massaging or vibrating motion.

SUMMARY

I have found that by placing a semi-rigid frame between front and rear padding and mounting a casing containing the vibratory mechanism on this frame at the lower portion thereof, a cushion may be formed which may be used at the back of the chair as prior cushions have been used but which gives a substantially improved sensation to the user. With this structure the casing containing the vibratory mechanism delivers its strongest effect to the back of the user at the lumbar region of the back, sometimes called "the small of the back," and by operation of the frame is found to deliver a more gentle but positive vibrating effect from the middle and upper portions of the cushion, thus yielding a most satisfying sensation to the user.

DETAILED DESCRIPTION OF THE INVENTION

One embodiment of my invention is illustrated in the accompanying drawings in which.

As illustrated, the improved cushion includes a rear padding sheet 10 which is rectangular in shape and substantially uniform in thickness. Over or in front of the rear sheet 10 is a front padding sheet 11 which is also rectangular and about the same size as sheet 10; and over or in front of sheet 11 is a preformed pad 12 which is attached at the upper portion of sheet 11. This pad 12 along with the upper ends of sheets 10 and 11 forms the padding for the pillow part of the cushion.

Figure 5:
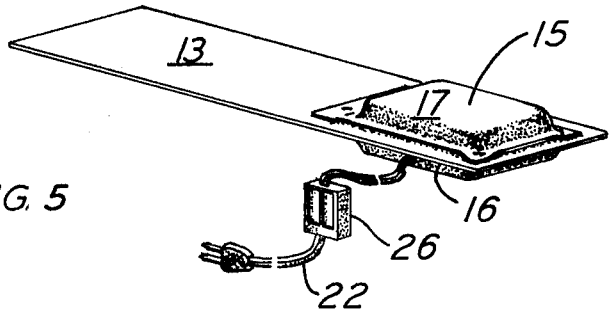
FIG. 5 is a perspective view of the frame on which the vibrator casing is mounted.

A frame 13 which carries the vibrator mechanism and is more clearly shown in FIG. 5, is disposed between sheets 10 and 11. This frame may be of any material which contributes rigidity yet is strong and flexible enough to resist being broken in the normal use of the cushion, and which is not so thick or heavy as to add excessive weight. Composition or fiberboards which are available commercially are quite suitable for this purpose.

As illustrated, the frame is shown as a composition board 13 of elongated rectangular shape. This board is somewhat smaller than the rectangular padding sheets 10 and 11. At the lower section of this board there is an opening, and across this opening the casing 15 is to be fitted.

Casing 15 may suitably be of metal and may be formed of two side pieces, including the rear side 16 and the front side 17. Each of these side pieces contains a depression having rounded edges and a planar central surface. The vibrating mechanism 20 is mounted to side 16 at about the center of its planar surface. The front side 17 is inverted and placed over the side 16 to form an enclosure about the vibratory mechanism.

The vibratory mechanism may be of any suitable type. As illustrated, it includes a substantially U-shaped piece 18, a core 19 attached to one leg of the U-shaped piece 18, and a wire coil 21 which, when energized, moves this side of the piece alternately toward and away from the other leg of the U-shaped piece. In operation this results in the vibration of the casing, which in turn is transmitted through the cushion to that part of the person's body which is resting against the cushion. The electrical cord 22 may be connected into an electrical outlet and leads from the outlet to the vibrator mechanism within casing 15.

Figure 1:
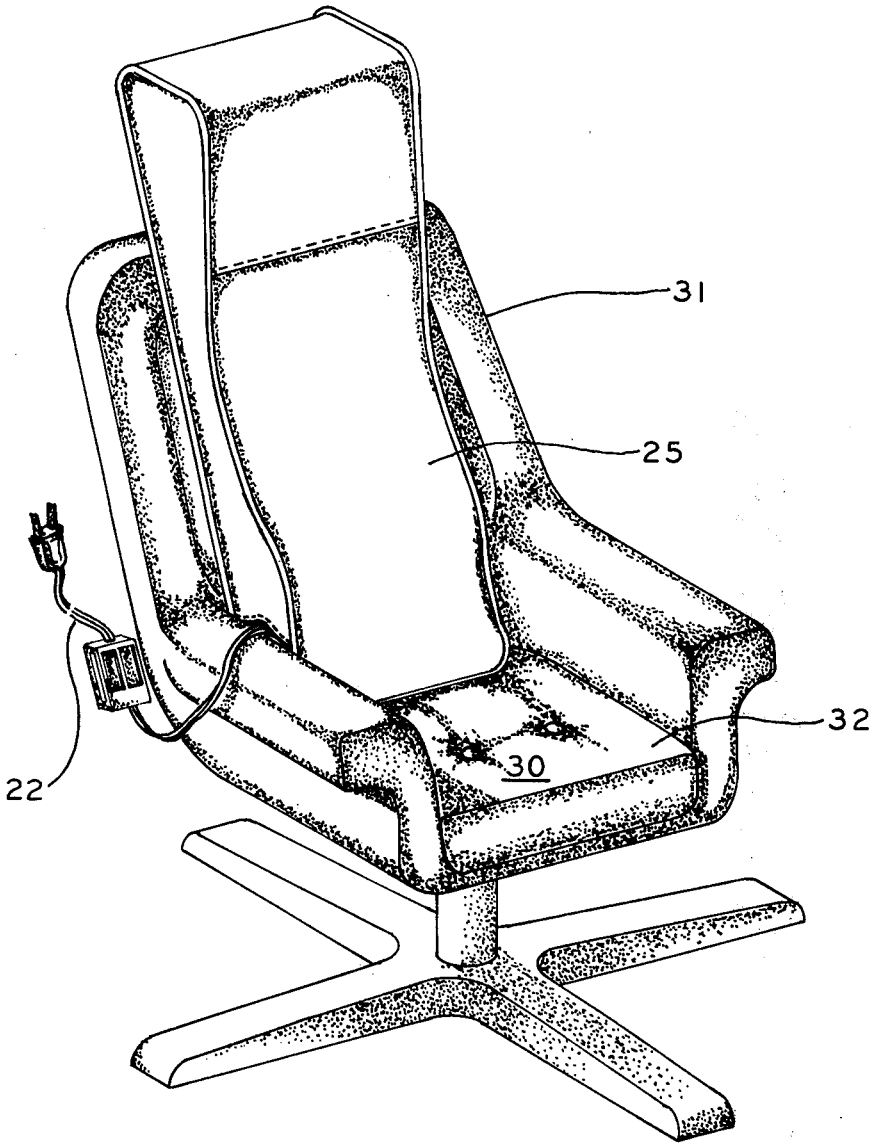
FIG. 1 is a perspective view of the improved cushion in place in a chair.
Figure 2:
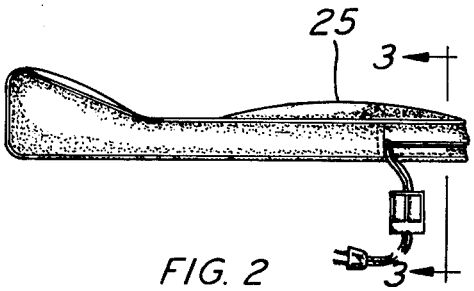
FIG. 2 is a side view of the improved cushion.
Figure 3:
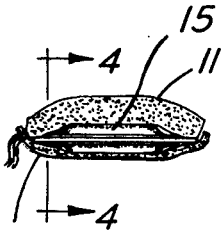
FIG. 3 is a sectional view of the padding and center frame taken as seen from line 3—3 of FIG. 1.
Figure 4:
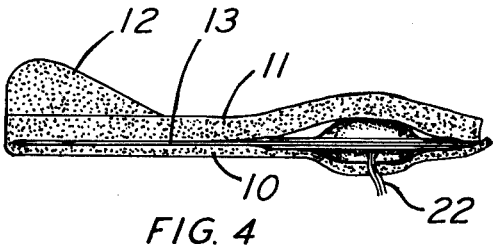
FIG. 4 is a sectional view of the padding and center frame taken along line 4—4 of FIG. 3.
Figure 6:
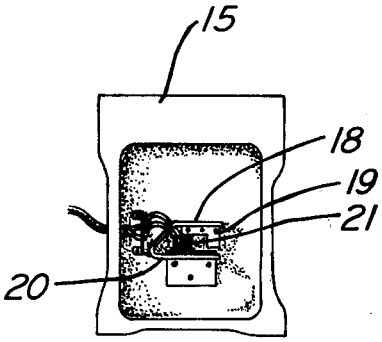
FIG. 6 is a detailed view showing the vibrator casing with its one side removed.
Figure 7:
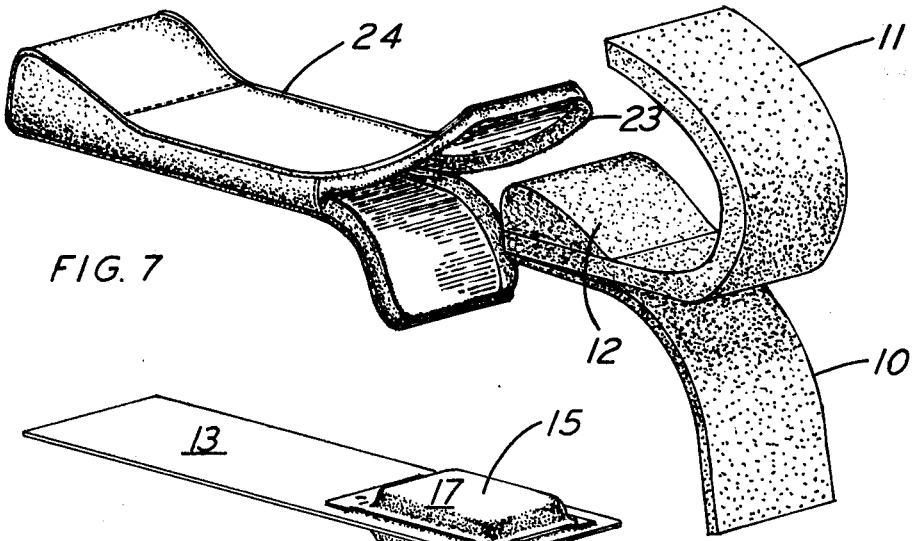
FIG. 7 is a perspective view showing the cover and illustrating how the padding portions are inserted into the cover.

One side of the casing 15 is fitted onto the opening in board 13 and the edges of sides 16 and 17 may be fastened in any suitable way to the board. Then the board, as shown in FIG. 5 may be inserted between the padding layers 10 and 11 as shown in FIG. 4, and this assemblage may then be inserted into the cover 24 as illustrated in FIG. 6. Suitably the bottom end of the cover may be provided with a Zipper 23 to facilitate making an opening for the padding and board into the cover.

In the location of the opening to which casing 15 is inserted and the placement of the board 13 between sheets 10 and 11, it is to be remembered that when the cushion has its lower end resting on a seat of a chair, the casing should be located in the lower one-third of the cushion so that the casing will register with the lumbar region or small of the back of the person sitting in the chair. With this condition, the vertical center of the casing is found to be in the range of from 5 to 8 inches from the bottom end of the cushion.

The insertion of casing 15 into the cushion produces a bulge in the cushion at the area 25 which is in register with the casing, and to accommodate this bulge the casing may be preformed to fit such a bulge. The bulge itself is desirable in that it allows the cushion to come forwardly and fit into the cavity at the lumbar region of a person's back.

To use the improved cushion a person may sit in chair 30 with the cushion between his back and the back 31 of the chair and with the lower end of the cushion resting on the seat 32 of the chair. The switch 26 may be turned on and this starts the vibrating mechanism in operation.

The strongest sensation will be felt by the person at the lumbar region of his back. This effect is obtained by transmission of vibrations by the casing through the padding sheet 11 to this region of the person's body. However, the casing also delivers a vibratory effect through the frame 13 to the upper part of the person's back and neck, but this effect is more gentle. Also the added padding in the head rest portion of the cushion serves to shield the head itself from the effect of the vibration. It is desirable that the lower part of the person's body receive the strong vibratory effect but it is undesirable, uncomfortable, or irritating that the skull of the person receive strong vibrations. Thus, the structure of the improved cushion gives the proper therapeutic effect.

Since this machine is intended to relax the user, it is important that motor noise be kept at a minimum. Positioning of the motor in the casing at the lower back, away from the head of the user, effectively accomplishes this goal.

While one specific embodiment of my invention has been illustrated and described in detail, it will be apparent to those skilled in the art that many embodiments may be constructed, and many changes made in the structure all within the spirit of the invention and within the scope of the following claims.

What is claimed is:

1. A back massager comprising a cushion having a front padding and a rear padding, the top end portion of said cushion being the pillow portion and constituting a head rest and the lower third part of said cushion being a back supporting portion, a frame member extending between said paddings, a casing mounted on said frame member and located between said front and rear paddings at said back supporting portion of the cushion, said casing being at a position in which it is substantially even with the lumbar region of an adult person when said cushion is at said person's back, vibratory mechanism contained within said casing for imparting vibrations to said casing, and a flexible cover about said paddings, said front padding having a section which is thicker than the remainder of the sheet and which is located at said pillow portion of the cushion, said cover being enlarged at said pillow portion to accommodate said enlarged section of said front padding.

2. A back massager comprising a cushion having a front padding and a rear padding, the top end portion of said cushion being the pillow portion and constituting a head rest and the lower third part of said cushion being a back supporting portion, a frame member extending between said paddings, a casing mounted on said frame member and located between said front and rear paddings at said back supporting portion of the cushion, said casing being at a position in which it is substantially even with the lumbar region of an adult person when said cushion is at said person's back, vibratory mechanism contained within said casing for imparting vibrations to said casing, and a flexible cover about said paddings, said frame having an opening therein and said casing extending across said opening.

3. In a cushion the top end portion of which serves as a head rest and the lower third of which is a back supporting portion, the improvement which comprises a center board in said cushion having an opening therein which opening is in the lower one-third thereof, a casing within said opening and attached to said board, vibratory mechanism within said casing for imparting vibrations to said casing, a layer of padding material over the front side of said board and the front side of said casing, a layer of padding material under the rear side of said board and under the rear side of said casing, and a flexible cover about said padding layers and enclosing said board and said casing.

4. A cushion as set forth in claim 3 in which the vertical center of said casing is from 5 to 8 inches from the bottom end of said cushion.

5. A cushion as set forth in claim 3 in which said casing is formed of two parts, a front part and a rear part, said parts being fastened together, and in which said vibrator is attached to said front part.

6. A cushion as set forth in claim 3 in which the depth of said casing together with the thickness of said front and rear padding causes said cushion to bulge to some degree in the area of said casing and in which said cover is fitted to accommodate the bulging of the cushion at said area.

* * * * *